US005495638A

United States Patent [19]

Zachhuber

[11] Patent Number: 5,495,638

[45] Date of Patent: Mar. 5, 1996

[54] SWEEPING UNIT

[76] Inventor: Kurt Zachhuber, Karlstr. 111, D-8122 Penzberg, Germany

[21] Appl. No.: 157,173

[22] PCT Filed: Jun. 9, 1992

[86] PCT No.: PCT/EP92/01294

§ 371 Date: Dec. 7, 1993

§ 102(e) Date: Dec. 7, 1993

[87] PCT Pub. No.: WO92/01275

PCT Pub. Date: Dec. 10, 1992

[30] Foreign Application Priority Data

Jun. 7, 1991 [DE] Germany ..... 4118708

[51] Int. Cl.[6] ..... A47L 5/30

[52] U.S. Cl. ..... 15/380; 15/51; 15/99; 15/320

[58] Field of Search ..... 15/380, 381, 78, 15/81, 51, 99

[56] References Cited

U.S. PATENT DOCUMENTS

| | | | |
|---|---|---|---|
| 1,689,497 | 10/1928 | Morgal | 15/380 |
| 2,073,145 | 3/1937 | Flint | 15/380 |
| 2,524,928 | 10/1950 | Platz | 15/380 X |

FOREIGN PATENT DOCUMENTS

| | | |
|---|---|---|
| 0103471 | 3/1984 | European Pat. Off. . |
| 0424229 | 4/1991 | European Pat. Off. . |
| 2573976 | 6/1986 | France . |
| 2652100 | 3/1991 | France . |
| 269549 | 7/1989 | Germany . |

*Primary Examiner*—Chris K. Moore
*Attorney, Agent, or Firm*—Helfgott & Karas

[57] ABSTRACT

A sweeping unit for a sweeping machine to clean a floor area, has a driven pair of closed loop sweeping belts for engaging the floor, the driven sweeping belts including a first portion fixed in position relative to a mounting platform and a second movable portion. First rollers constrain the first portions of the driven sweeping belts relative to the mounting platform, and second guide rollers, which are movable relative to the mounting platform, constrain the second portions of the belts, respectively. The width of the floor area that is swept when the sweeping machine moves in a working direction, is variable as the second guide rollers are moved manually or automatically. The sweeping unit may be combined with a scrubber device having similar width adjustment features.

15 Claims, 3 Drawing Sheets

SWEEPING UNIT

Figure 1:
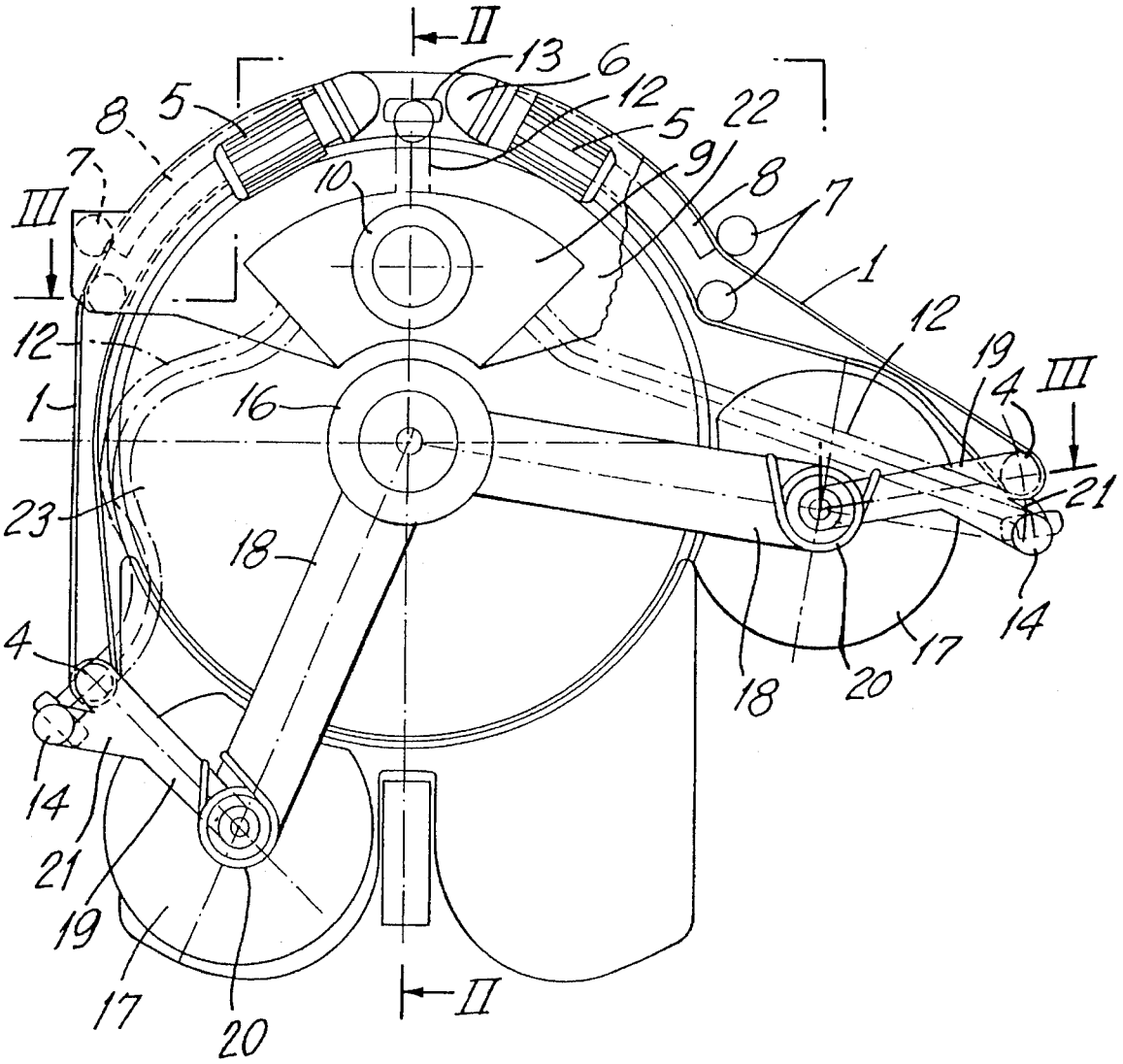

This invention concerns a sweeping unit, in particular as a supplementary equipment for a scrubbing suction-action machine, with at least one driven sweeping device provided on a guide, while the guide consists of several elements.

Such a sweeping unit, known from DD 269 549, has a transversely running brush belt which is guided about rollers having horizontal axes on both sides of a centrally situated suction orifice. The two brush belts can be pivoted in a horizontal plane into an open to the front V-shaped position, so that the sweeping unit could travel through narrow positions. The guide elements of the two brush belts, as far as belt guidance is concerned, are not displaceable, so that an automatic deflection when encountering an obstacle is not possible. Rather, the V-position of both brush belts has to be set accordingly before entering into an obstacle, to prevent the outer ends of the brush belts bumping into the limits forming the obstacles.

The known sweeping unit is not envisaged to be used as a supplementary device for a scrubbing suction-action machine.

In contrast to this, the object of this present invention is to produce a sweeping unit which makes inside and outside mechanical sweeping with variable working width feasible, so that an automatic adjustment of its contour can be carried out and which can also be used in conjunction with any scrubbing suction-action machine.

The cleaning of very dirty floors and such which have increased demands on such machines as far as cleanliness is concerned, should also be economical. The cleaning of such floors is carried out currently in such a manner that first the dirt lying loosely on the floor is swept away, usually by hand, and afterwards the dirt stuck to the floor is cleaned by means of a scrubbing suction-action machine. In numerous applications, e.g. when cleaning floors of supermarkets or departmental stores, the sweeping preceding the scrubbing is unavoidable. Hard dirt, e.g. glass splinters, would otherwise be picked up by the rotating scrubbing brushes which would lead to the damaging of the floor, or damage to the soft rubber stripper rail of the scrubbing unit. Furthermore, paper in particular, e.g. thrown away cash register slips would adhere to the floor which had been wetted by the scrubbing process. Thus the two working processes (sweeping and scrubbing) which are frequently required when cleaning floors and which have to be carried out in succession, will consequently result in high costs.

A particular objective of this invention is also to use the sweeping unit in conjunction with a scrubbing suction-action machine having a variable working width, which is the subject matter of the German patent P 41 03 087. The working width of the sweeping unit should also be variable similar to the working width of the scrubbing suction-action machine.

According to the invention this objective is achieved by a generic sweeping unit wherein one group of elements which form a guide is fixed on the sweeping unit, another group of elements are displaceabe for the purpose of altering the sweeping width of the sweeping unit. The term "guide" elements of the sweeping device means the totality of individual elements, which serve the purpose of guidance and width adjustment of the sweeping device; in particular reversing rollers, pressure rollers, guide rollers, sliding surfaces, guide rails and the like may be considered as guide elements. The sweeping device may comprise hand driven or motorized brooms of designs known in the field of cleaning machines, e.g. plate brooms rotating about vertical axes or roller brooms rotating about horizontal axes or bristle-studded endless sweeping belts.

If endless sweeping belts are used, it is useful if at least two endless sweeping belts (1) are provided which rotate in an upright configuration about the guide elements.

The displacement of the guide within the sweeping unit may take place by various means; those guide elements, for example, which can be displaced, may be made pivotable, so that they would include a varying angle with the working direction; furthermore, in case several guides are provided with sweeping belts, they may be displaceably mounted laterally on the sweeping unit. Finally, displacement is feasible as the guide is inherently deformably constructed, i.e. the position of the individual elements of the guide can be altered relative to each other, so that the path of the rotating sweeping belt may take up different shapes (straight, curved inward/outward or forward/rearward). For this purpose the components connecting the elements of the guide may consist, for example, of a flexible material or may be constructed of members which are joined with each other in an articulated manner. The construction of the broom as a continuous sweeping belt is especially advantageous when a deformable guide is provided; in this manner with the adjustment of the position of the guide the position of the broom can also be adjusted in a simple manner to suit the respective desired working width. Furthermore, the construction of the broom as a sweeping belt has the particular advantage, that the dirt picked up (more directly than in the case of roller brooms/sweeping rollers/and plate brooms) is conveyed to a narrowly limited region, namely to the reversing point of the sweeping belt; consequently, the suction can be limited to this narrowly restricted region, i.e. the suction orifice can be correspondingly small, leading to a small throughput rate of the exhausted air and, in turn, to a small power requirement for the exhaust unit. This has particular significance in that the sweeping unit, according to the invention, should also be able to be operated in combination with a scrubbing suction-action machine which is independent from the mains and have a correspondingly limited battery capacity. The sweeping unit according to the invention preferably has at least two endless sweeping belts with associated guides, wherein the sweeping belts run about the guide elements in an upright configuration. At the same time, at least one pair of sweeping belts is preferred, wherein the sweeping belts are driven in opposing directions to each other and convey the dirt to a suction orifice of a suction device provided between the two sweeping belts of the pair which picks up the swept-up material. Accordingly, the reversing points of both sweeping belts of the pair are arranged close to each other and in the vicinity of the common suction orifice. It is conceivable in this case, that two further sweeping belts could be connected in a staggered manner behind the pair of sweeping belts mentioned, while the two front sweeping belts are fixed in a suspended manner on the sweeping unit and the sweeping belts connected behind them can be laterally moved and/or pivoted; this permits for rigid construction of each individual guide, i.e. in particular to mount all elements of a guide on a common rigid carrier, which are suspended inside of the sweeping unit either rigidly or displaceably. Conversely, the guides, as such, may be deformable, i.e. the individual elements of the guide can change their position relative to each other. This will change the contour of the sweeping belt, rotating around the guide elements. The carrier, connecting the guide elements with each other, comprises appropriately in this case several sections, which are joined articulately with each other. In the case that several guides with rotating sweeping belts are provided, they can preferably be displaced independently from each other. This will permit a single-sided alteration of the working width, when, for example, an obstruction occurs on one side only. This will increase the flexibility of the selection of the optimum working width compared with corresponding sweeping belt guides, which are displaceable only symmetrically in pairs.

In the case of a preferred development of the sweeping unit a suction orifice is provided at each reversing point of the sweeping belt. It is because not only the front section, viewed in the working direction, of the sweeping belt picks up dirt, but the rear section also conveys a certain amount of dirt to the relevant reversing point, as a 100% sweeping efficiency cannot be technically achieved by the front section of the sweeping belt. Appropriately, in the region of each suction orifice a stripper hook is provided, the bristles of the sweeping belts brushing against it. The effect is that the dirt from the bristles will be loosened better and can be picked up by suction orifices of the suction device. At the same time the sweeping efficiency can be increased as the bristles of the sweeping belts being inclined against the direction of motion, i.e. the bristles point forward at an angle in the direction of rotation of the sweeping belts.

When using sweeping belts it is also advantageous to pick up rough dirt, if in the region of the suction orifices and/or directly along the rear side of the sweeping belt a stripper is provided. In this case one deals usefully with a conventional belt-shaped elastic bar which glides over the floor surface, the length of which can be extended together with the sweeping belt.

Appropriately, when viewed in the working direction a deflector bracket is provided in front of the sweeping belts, which bracket, when encountering an obstruction, affects the displacement of the carrier so that the sweeping width will be reduced. For this purpose various technical solutions are conceivable. For example, the deflector bracket may be constructed as a scanner, which, in turn, controls an electric, pneumatic, hydraulic or similar adjusting device to pivot and/or move the corresponding sweeping belt guide assigned to it. On the other hand, especially in the case of small sweeping units, the deflector bracket can be constructed so that it directly moves and/or pivots the sweeping belt guide assigned to it when it encounters an obstruction, i.e. the corresponding guide is directly moved and/or pivoted by the obstruction affecting the deflector bracket until the sweeping unit is able to pass the obstruction.

To keep the stirring up of the dust at as low a level as possible, the sweeping unit can have an additional misting system. In this case the to-be-vaporized fluid is removed by suction from a storage tank by means of a pump and sprayed about through pressure hoses, which are fastened along the sweeping belts and have a plurality of vaporizing nozzles.

The sweeping unit according to the invention can be mounted on a chassis thus forming an independent sweeping suction-action machine. In an advantageous manner it is also feasible to construct a scrubbing suction-action unit with variable working width according to the German patent P 41 03 087 and mount a sweeping unit according to the invention on a common chassis, so that a combined sweeping and scrubbing suction-action machine will be produced. In this case the working width of the sweeping unit and of the scrubbing suction-action unit are coordinated with each other, i.e. the displaceable parts are joined with each other. A development of the sweeping unit according to the invention is particularly useful in a manner wherein the mounting means for a rapid assembly on a scrubbing suction-action machine are according to the German patent P 41 03 087. The fastening means used for the rapid assembly of the sweeping unit to the scrubbing suction-action machine are known as such from the state-of-the-art.

Figure 2:
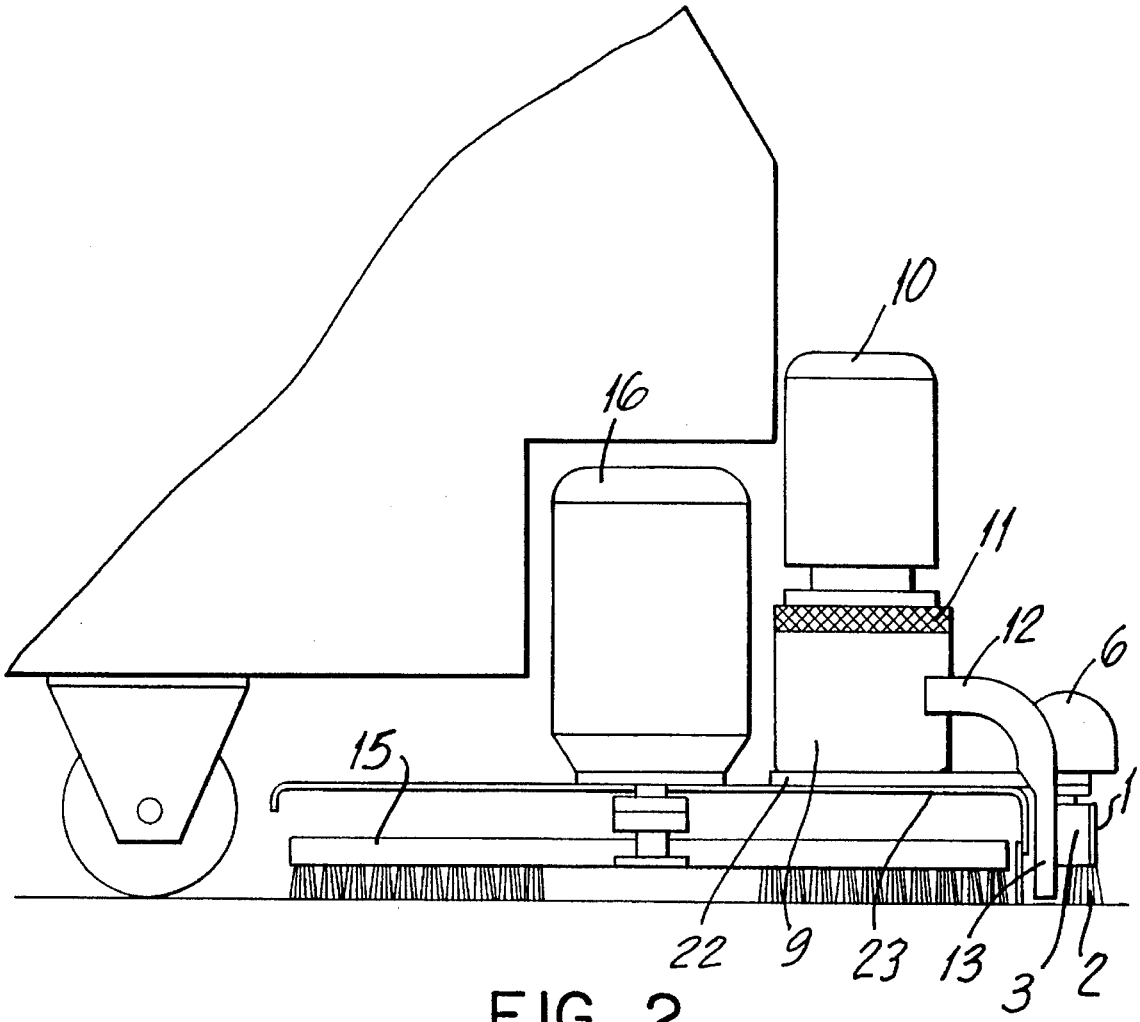
Figure 3:
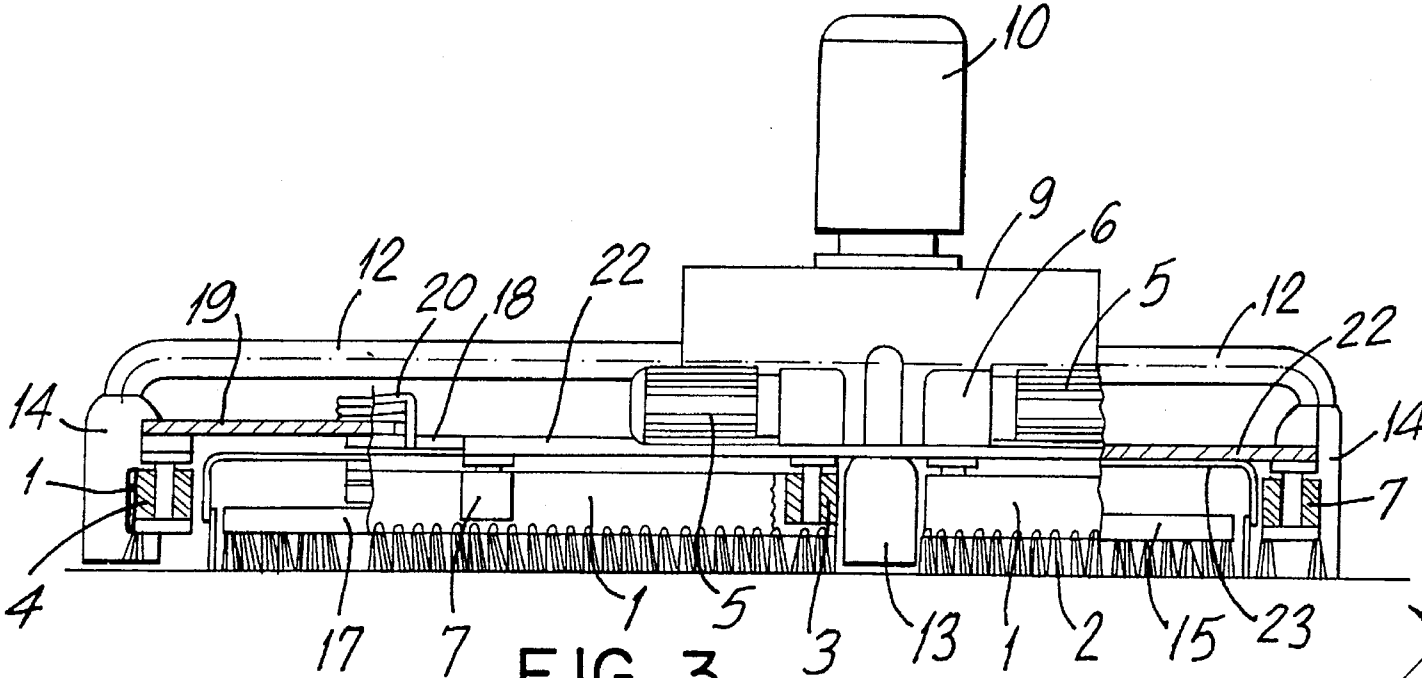
Figure 4:
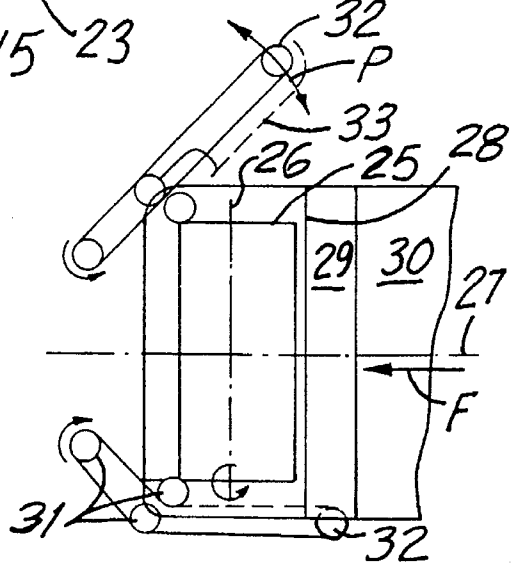

The invention with a sweeping device in the form of a continuous endless sweeping belt is explained in detail below based on the following drawings:

FIG. 1—a top view of a sweeping unit according to the invention when mounted on a scrubbing suction-action machine;

FIG. 2—a across section of the combined sweeping and scrubbing suction-action machine according to FIG. 1, taken along the line II—II;

FIG. 3—a across section of the combined sweeping and scrubbing suction-action machine according to FIG. 1, taken along the line III—III;

FIG. 4—a schematic top view of a version of the sweeping machine.

The sweeping unit illustrated in the drawing contains two endless sweeping belts 1, which are fitted at their bottom edges with bristles 2. At the same time the sweeping belts are made of a flexible, stretch-resistant belt material or of articulated elements which are connected with each other in a chain-like manner. Both sweeping belts run between a drive roller 3 and a reversing roller 4, which define both turning points. A horizontal drive motor 5 is provided for each of the two sweeping belts, which motor is connected with the respective drive roller 3 via a bevel gear transmission. Two additional guide rollers 7 as well as guide surfaces 8 are provided to guide the sweeping belt.

The suction unit comprises the suction reservoir 9, on which the suction motor 10 is mounted, which drives the exhaust fan (not illustrated). A filter is installed on the suction reservoir as a separator device 11, which filter separates the dirt picked up by the sucked in air and retains the dirt in the suction reservoir. Three suction hoses 12 enter the suction reservoir 9, which suction hoses are each connected with a front, central suction orifice 13 and an external, rear suction orifice 14. (Not to conceal the parts lying below, the suction hoses 12 in FIG. 1 are indicated by dash-dot lines only). At the same time the front, central suction orifice 13 is provided between the two front ends of the sweeping belts where they rotate around the drive rollers 3. The rear suction orifices 14 are provided directly behind the reversing points of the sweeping belts, which are defined by the reversing rollers 4. The suction motor is supplied by a current source (not illustrated).

The sweeping unit illustrated in FIGS. 1–3 is mounted on a scrubbing suction-action machine known from the German patent P 41 03 087, the outline of which is indicated by thin lines and the details of which are apparent from the above mentioned [patent] application. Important is that in addition to the main brush 15, which is driven by the drive motor 16, displaceable supplementary brushes 17 are provided, wherein each of the supplementary brushes can pivot laterally by means of a respective swinging arm 18. In accordance with FIG. 1, when viewed in the working direction, the left supplementary brush is in its retracted position and the right supplementary brush is in its extended position. For the interaction of the sweeping unit and the scrubbing suction-action machine in such a manner that the working widths of the two units would be harmonized with each other, tensioning levers 19 are hinged on the swinging arms 18 of the scrubbing suction-action unit, each of which carries a reversing roller 4. At the same time the tensioning levers 19 can pivot about a vertical axis relative to the swinging arm 18. A spring 20, arranged between each swinging arm 18 and the associated tensioning lever 19, pre-tensions the tensioning lever to such an extent, that the sweeping belt 1 will be tightened to its optimum. On each tensioning lever 19 a brace 21 is provided, which serves the purpose of holding the respective external, rear suction orifice 14.

The drive motors 5, guide rollers 7 and guide surfaces 8 of each sweeping belt 1, as well as the suction reservoir 9 and the front suction orifice 13 are mounted on a common mounting platform 22, which is secured on the hood 23 of the main brush 15 of the scrubbing suction-action unit. To illustrate the parts of the guide arranged below the mounting platform, in FIG. 1 the mounting platform is shown in a broken view on the right-hand side of the sweeping unit.

The sweeping device of the sweeping unit can be driven by a motor or by hand. If it is hand driven, a transmission unit which is coupled in the usual manner with the wheels of the pushed sweeping unit may be used. In addition, a battery for the electric motor drive of the exhaust fan of the suction unit, may be provided. Also, instead of a suction unit another storage device for the swept up material may be used, for example, a bristle-studded pick-up roller, which conveys the swept up material rearwards, preferably over a ramp which ends near to the ground or grazes the surface of the ground, into a swept-up material container joined to it. Such is illustrated in FIG. 4.

FIG. 4 shows a top view of the front half of a sweeping machine whose sweeping unit does not have a suction unit. Instead of a suction unit the sweeping unit has a sweeping roller 25, which rotates about a horizontal axis 26, which is situated at a right angle to the longitudinal axis 27 of the sweeping machine. The sweeping roller 25 conveys the swept-up material which has been picked up between the front ends of the two sweeping belts 1 upwards over a stripper rail 29, the leading edge 28 of the stripper rail being on the ground and then rising in a ramp-like fashion to a swept-up material container 30 connected to the stripper rail 29. Of the two sweeping belts 1, the top one in the plane of the drawing is illustrated in extended position and the bottom one is illustrated in an inward pivoted position. While the three front guide rollers 31, viewed in the direction of travel F, are mounted on the machine, the rear reversing roller 32 can be pivoted according to the double arrow P, due to which the variable sweeping width of the sweeping machine can be realized. On the example of the above shown sweeping belt a stripper 33 is also indicated in broken line, which moves in unison with the pivotable rear section of the sweeping belt.

I claim:

1. A sweeping unit for use with a sweeping machine to clean a floor area when said sweeping unit moves in a working direction, the sweeping unit comprising:

a mounting platform;

driven sweeping means for engaging said floor area, said driven sweeping means including a first portion and a second portion;

first guide means for constraining said driven sweeping means relative to said mounting platform, said guide means including first guide elements positioned at fixed locations on said mounting platform, and a second guide element which is movable relative to said mounting platform generally in a plane, said first portion of said driven sweeping means being constrained to a fixed path relative to said platform by said first guide elements, said second portion of said driven sweeping means being constrained by said second guide element to movement generally in said plane, a distance between a fixed line oriented in said working direction on said platform and said second guide element being varied as said second guide element is moved, whereby a width of said floor area that is swept when said sweeping machine moves in said working direction, is variable; and means for movably mounting said second guide element relative to said platform.

2. The sweeping unit according to claim 1, wherein said driven sweeping means includes a first bristle-studded sweeping belt in an endless loop.

3. The sweeping unit according to claim 1, further comprising a scrubbing suction-action unit having a variable working width, said scrubbing suction-action unit being connected to said mounting platform and to said means for movably mounting said second guide elements said means for movably mounting said second guide elements including linking means for joining said second guide element to said scrubbing suction-action unit, working widths of the driven sweeping means and of the scrubbing suction-action unit being variable in unison.

4. A sweeping unit according to claim 3, wherein said sweeping belt has its second guide element mechanically coupled with a displaceable scrubbing brush of said scrubbing suction-action unit, said scrubbing brush and coupled second guide element moving in unison relative to said mounting platform.

5. The sweeping unit according to claim 4, wherein said means for movably mounting said second guide element includes a swinging arm, said displaceable scrubbing brush being attached at one end of said swinging arm, and a tensioning lever rotatably mounted at one of its ends to said one end of said swinging arm, another end of said tensioning lever carrying said second guide element, another end of said swinging arm being pivotably mounted at a fixed position relative to said supporting platform, said sweeping belt turning around said second guide element.

6. The scrubbing unit as in claim 5, wherein said second guide element is a rotatable roller.

7. A sweeping unit according to claim 5, further comprising bias means for urging said tensioning lever to maintain said sweeping belt in tension as said second guide element moves relative to said mounting platform.

8. A sweeping unit as in claim 2, wherein said driven sweeping means further includes a second sweeping belt that is similar to said first sweeping belt and constrained by second guide means having guide elements similar to said guide elements of said first guide means, a respective first guide element in each said guide means being rotatably driven and engaging a respective sweeping belt to move said belt loop along surfaces of respective guide elements, said respective driven first guide element rotating about a generally vertical axis; in use, said belts being generally perpendicular to said floor area.

9. The sweeping unit according to claim 8, wherein said sweeping belts and the respective first guide elements are symmetrical about said working direction.

10. The sweeping unit according to claim 9, wherein each of said second guide elements is independently displaceable.

11. The sweeping unit as in claim 9, wherein in each said guide means said second portion moves pivotably relative to said first portion.

12. The sweeping unit according to claim 11, further comprising a suction unit having non-displaceable components, said non-displaceable components of the suction unit being on said mounting platform.

13. The sweeping unit according to claim 8, further comprising a suction device including at least one suction orifice wherein one of said at least one suction orifice is a central suction orifice, said first portions of said sweeping belts being symmetrically provided and driven in opposing directions, said central suction orifice being between adjacent first reversing points of each of said closed sweeping belt loops.

14. The sweeping unit according to claim 8, further comprising a suction orifice provided at each second reversing point of each of said closed sweeping belt loops.

15. The sweeping unit according to claim 8, wherein said guide means includes guide rollers, rotating about respective vertical axes, and guide surfaces.

* * * * *